US007767060B2

(12) United States Patent
Ratia

(10) Patent No.: US 7,767,060 B2
(45) Date of Patent: Aug. 3, 2010

(54) CREPING MACHINE

(75) Inventor: Juan Antonio Torra Ratia, Gijon (ES)

(73) Assignee: E. I. du Pont de Nemours and Company, Wilmington, DE (US)

( * ) Notice: Subject to any disclaimer, the term of this patent is extended or adjusted under 35 U.S.C. 154(b) by 787 days.

(21) Appl. No.: 11/386,405

(22) Filed: Mar. 22, 2006

(65) Prior Publication Data

US 2007/0221347 A1 Sep. 27, 2007

(51) Int. Cl.
*D21G 3/00* (2006.01)
*D21G 7/00* (2006.01)

(52) U.S. Cl. ..... 162/281; 162/280; 162/263; 15/256.5; 118/413; 72/191; 425/374; 700/127

(58) Field of Classification Search ..... 162/198–199, 162/263, 272, 252, 280–281; 15/256.5, 256.51; 118/413; 425/328, 374; 26/18.6; 72/191; 700/127–129

See application file for complete search history.

(56) References Cited

U.S. PATENT DOCUMENTS 2,853,411 A * 9/1958 Riley ..... 428/153
3,260,778 A 7/1966 Walton
3,319,352 A * 5/1967 Haigh ..... 34/123
3,416,192 A 12/1968 Packard
3,426,405 A 2/1969 Watton
3,427,376 A * 2/1969 Dempsey ..... 264/282
3,452,409 A * 7/1969 Hodges et al. ..... 264/282
3,641,234 A * 2/1972 Trifunovic et al. ..... 264/282
3,810,280 A * 5/1974 Walton et al. ..... 264/282
4,090,385 A 5/1978 Packard
4,192,709 A * 3/1980 Dunlap ..... 162/111
4,324,613 A * 4/1982 Wahren ..... 162/111
4,556,454 A * 12/1985 Dahl et al. ..... 162/358.3
4,570,314 A * 2/1986 Holik et al. ..... 162/358.3
4,661,206 A * 4/1987 Heitmann et al. ..... 162/358.3
4,815,183 A * 3/1989 Bondetti ..... 492/7
4,858,292 A * 8/1989 Buhlmann et al. ..... 492/7
4,919,877 A * 4/1990 Parsons et al. ..... 264/282
5,403,446 A * 4/1995 Trelsmo et al. ..... 162/281
5,666,703 A * 9/1997 Walton et al. ..... 26/18.6
6,205,369 B1 * 3/2001 Moore ..... 700/122
6,458,247 B1 * 10/2002 Uuttana ..... 162/281
2003/0033727 A1 * 2/2003 Stelljes et al. ..... 34/361
2005/0098292 A1 * 5/2005 Ried et al. ..... 162/281
2005/0126031 A1 * 6/2005 Herman et al. ..... 34/114
2005/0133186 A1 * 6/2005 Hultcrantz ..... 162/358.1
2007/0221347 A1 * 9/2007 Ratia ..... 162/111
2008/0036135 A1 * 2/2008 Horn et al. ..... 162/111

* cited by examiner

*Primary Examiner*—José A Fortuna

(57) ABSTRACT

A machine for creping sheet material such as paper, textiles, metal foils, or plastic, comprises a driving drum, and a pressing plate for pressing a length of sheet material against the drum to drive the material lengthwise in the machine direction, and a retarding member arranged to contact the lengthwise-driven sheet material to cause it to crepe. The pressing plate has a plurality of pressure application points or areas distributed across the width of the sheet material on the drum, the pressure application points or areas being associated with pneumatic cylinders for applying different pressures to different parts of the material across its width according to a given pressure profile. The pneumatic cylinders can be arranged in groups to provide an adjustable pressure profile across the material wherein the pressures applied at the opposite edges of the material and at intermediate parts of the material are adjustable independently of one another. A machine retrofitted according to the invention operates at increased speed with less defects and higher efficiency.

6 Claims, 4 Drawing Sheets

CREPING MACHINE

FIELD OF THE INVENTION

This invention relates to machines for creping sheet materials such as paper, textiles, metal foils, or plastic, of the type comprising a driving member, means for pressing a length of sheet material against the driving member to drive the sheet material lengthwise, and a retarding member arranged to contact the lengthwise-driven sheet material to cause it to crepe.

BACKGROUND

Creping machines of the above type are known, for example, from U.S. Pat. Nos. 3,260,778; 3,416,192; 3,426,405, and 4,090,385. As described in these patents, the pressing member can be a plate applied by one or more pneumatic presses that apply the plate against the driving member, which is typically a drum, with a substantially constant pressure. The driven sheet material then engages with a retarding member which can be an inclined surface that deflects the driven sheet away from the drum and, by retarding the driven sheet, causes it to crepe.

Creping converts the flat surface of the sheet material into a corrugated surface giving flexibility to the product. In the textile industry, creping is mainly used to provide comfort or elasticity with so-called stretch fabrics, whereas in the paper industry creping is associated with other needs like paper for decoration and other applications.

Creping is also used for non-woven fabrics where the production of fabric begins with the production of a web that can incorporate many combinations of fibers and paper types.

In the aforementioned patent literature, the pressing means is a pressure plate associated with a pneumatic cylinder designed to apply a substantially constant pressure across the sheet material.

In some commercial machines, the pressing means is a pressure plate provided with a plurality of pressure application areas distributed across the width of the sheet material on the driving member, the pressure application areas being associated with groups of pneumatic cylinders for applying different pressures to different parts of the material across its width according to a given pressure profile. Such an arrangement has been used to apply a pressure profile where increased pressure is applied to the two edges of the pressing member and a decreased pressure is applied in the middle. This is done by linking together the pressure application cylinders as follows. The two outermost pneumatic cylinders are linked together (highest pressure); the two next innermost pneumatic cylinders are linked together (medium pressure); and several inside pneumatic cylinders are linked together (lowest pressure). This arrangement, with increased pressure at the edges, has proven adequate only for some products, mainly paper products.

Fabrics are creped from slits coming from mother rolls wide enough to be creped in one standard machine. The shape of the fabric is related to the basis weight profile which varies in the cross direction, transverse to the direction of sheet material feed (i.e. the machine direction). The basis weight of a fabric is typically greater at the edges than in the center. It has been tried to reduce such problems by adjusting the pressure on one side using shims between the pressure plate and the fabric, but this creates marks and other quality control problems.

Hence the existing machines do not operate satisfactorily for all types of sheet material.

SUMMARY OF THE INVENTION

In one embodiment, the present invention is directed to a machine for creping sheet material, comprising a sheet material driving device, pressing means for pressing a length of sheet material against the driving device extending across the width of the driving device, and a retarding member arranged to contact the sheet material to cause it to crepe, wherein the pressing means comprises a plurality of independently adjustable pressure application areas distributed across its width for applying different pressures to different parts of the sheet material across its width.

In another embodiment, the present invention is directed to a method of creping sheet materials, comprising passing a sheet material over a driving device, measuring the thickness of different parts of the sheet material across its width, and independently applying varying pressures to said different parts of the material across its width according to the measured thickness of the material.

BRIEF DESCRIPTION OF THE DRAWINGS

The invention will be further described by way of example with reference to the accompanying drawings.

DETAILED DESCRIPTION

Figure 1:
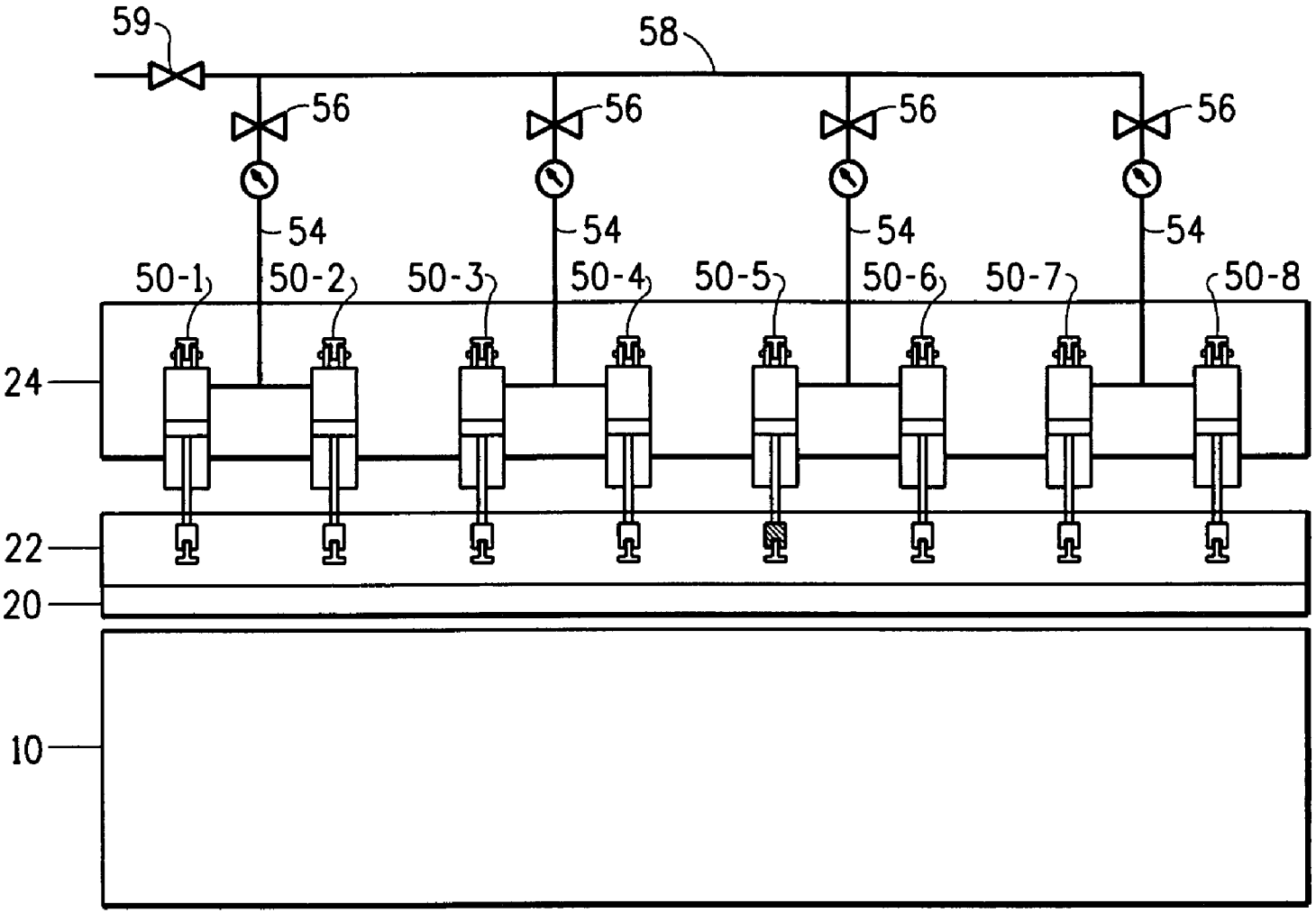
FIG. 1 is a schematic front view of a machine for creping sheet materials according to the invention.

According to the invention, in a machine of the aforementioned type, the pressing means comprises pressure application points or areas distributed across the width of the sheet material on a sheet material driving device, such as a rotary drum, and the pressure application points or areas are associated with actuating means, such as pneumatic or hydraulic cylinders for independently applying different pressures to different parts of the material across its width according to a desired pressure profile. The pressing means can comprise a series of pressure plates, each of which is independently activated by pressure-applying members, arranged across the cross direction of the machine, such that the pressure application points or areas can provide a varying pressure profile across the material wherein the pressures applied at the opposite edges of the material and at intermediate parts of the material are adjustable independently of one another. Pressure is hence applied when and where needed.

With the inventive machine, it is possible to adjust the creping pressure in a wide range and to configure the pressure profile according to the specific requirements of different sheet materials, which minimizes adjustments of the machine, avoids the need to use shims, and enables adjustments to be made during machine operation, so that the creping operation can be fine tuned as a function of the properties of the material being creped. One advantage of the present invention is that it has been possible to sustain an increase of the capacity of the creping machine by an amount of the order of 10-15% or more, mainly due to the reduction of quality problems and the possibility to better control the product with an increase of the speed of the sheet material.

The inventive arrangement also provides for better possibilities for creping folded sheet materials, while at the same time being also excellent for creping single layer sheet materials.

Typically, the pressing means comprises from three to eight pressure application areas, each associated with means for applying an adjustable pressure to the given area independently of the pressures applied to the other areas. For example, there can be several of pressure application areas each associated with one to three pressure-applying members such as pneumatic cylinders, for instance three to five pressure application areas, in particular four pressure application areas, each associated with two pressure-applying members.

In a preferred embodiment of the invention, the machine further comprises means for measuring the thickness of different parts of the sheet material across the rotary drum driving member, whereby the measuring means provides a signal for independently controlling the application of pressure to said different parts of the material across its width according to the measured thickness of the material.

Another aspect of the invention is a method of creping sheet materials using the inventive machine. One inventive method comprises measuring the thickness of different parts of the sheet material across the driving member, and controlling the application of pressure independently to said different parts of the material across its width (i.e. in the cross direction), according to the measured thickness of the material. In this method, an asymmetric pressure profile can be applied to the sheet material, with the creping pressure applied to one edge of the material being higher than the creping pressure applied on the other edge of the material. The application of other pressure profiles is, of course, also possible.

Figure 2:
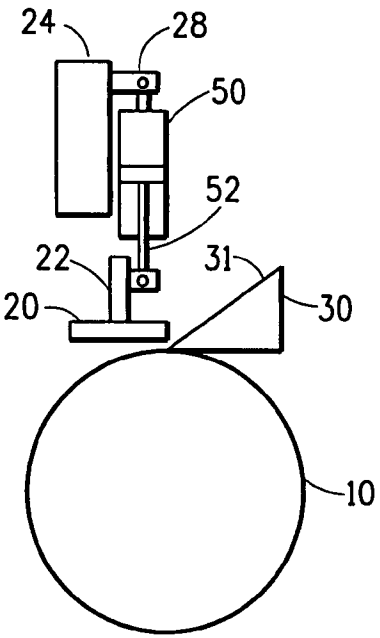
FIG. 2 is a side view from the left hand side of FIG. 1.

FIGS. 1 and 2 show an embodiment of a machine for creping sheet material according to the invention. The machine comprises a sheet material driving device in the form of a conventional rotary drum 10. A pressure plate 20 is arranged for pressing a length of sheet material 40 (see FIG. 5) against the drum 10 to drive the sheet material in the machine direction. A wedge-shaped retarding member 30 is arranged in the cross direction to contact the driven sheet material to cause it to crepe, in the conventional way (see for example U.S. Pat. Nos. 3,260,778 and 4,090,385), by engagement of the driven sheet material on an inclined surface 31 that deflects the driven sheet away from the drum 10 and, by retarding the driven sheet, causes it to crepe. For this purpose, the inclined surface 31 is inclined relative to the sheet material driven by the driving device, in this example by being inclined to a tangent on the drum's surface just downstream of the pressure-applying edge of plate 20.

The pressure plate 20 has towards its downstream edge a continuous smooth surface for engaging the sheet material 40 and pressing it against the surface of the drum 10.

The drum 10 can have a smooth continuous surface or alternating grooves and ribs, as described in U.S. Pat. No. 4,090,385. The drum 10 can be of any convenient size, usually up to about 88" (225 cm) wide.

The pressure plate 20 extends across the width of the drum 10 and has a longitudinal flange 22 that is suspended from an upper bar 24 by a series of pneumatic cylinders 50, whose piston rods 52 act on lugs 26 fixed on the flange 22. At their upper ends the pneumatic cylinders 50 are fixed on lugs 28 on the upper bar 24.

In the given example, there are eight pneumatic cylinders 50-1 to 50-8 connected in pairs by four air-lines 54 with pressure-adjustment valves 56 to a common air-line 58 connected via an on-off valve 59 to a source of pressurized air (not shown). By means of the pressure-adjustment valves 56, the pressure in each pair of pneumatic cylinders (50-1/50-2, etc.) can be set at a selected value.

Figure 3:
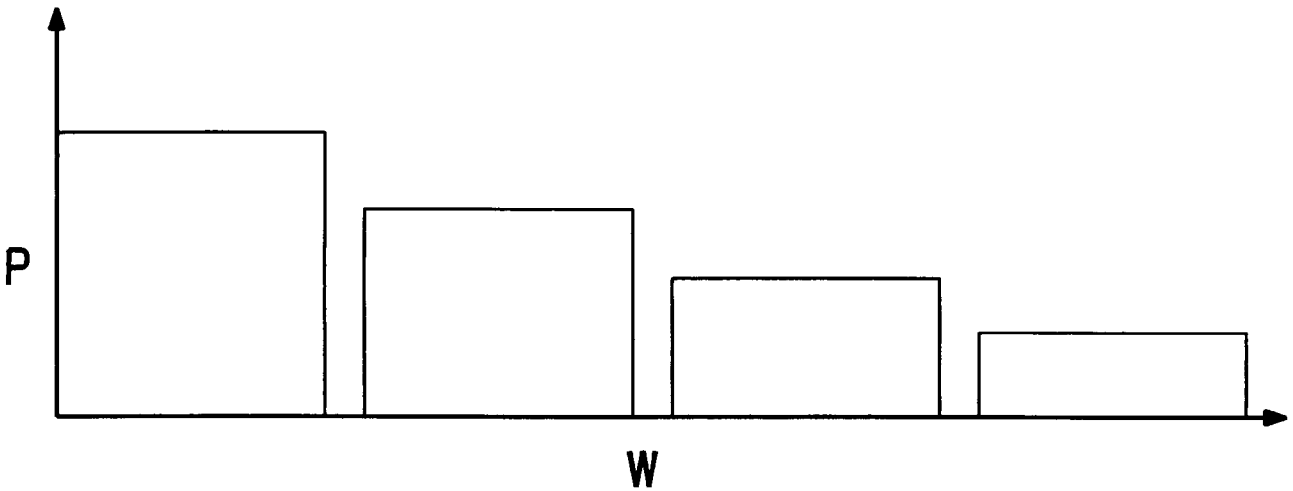
FIG. 3 is a graphical representation of a pressure profile obtainable with the machine of FIGS. 1 and 2.

The different pairs (50-1/50-2, etc.) of pneumatic cylinders correspond to four pressure-application areas of the pressure plate 20 distributed across the width of the sheet material on the drum 10, the pairs of cylinders (50-1/50-2, etc.) being arranged for applying different pressures (P) to different parts of the material 40 across its width (W) according to a given, adjustable pressure profile, for example, that illustrated in FIG. 3, wherein the pressure applied decreases progressively from the left to the right, looking at FIG. 3.

Figure 4:
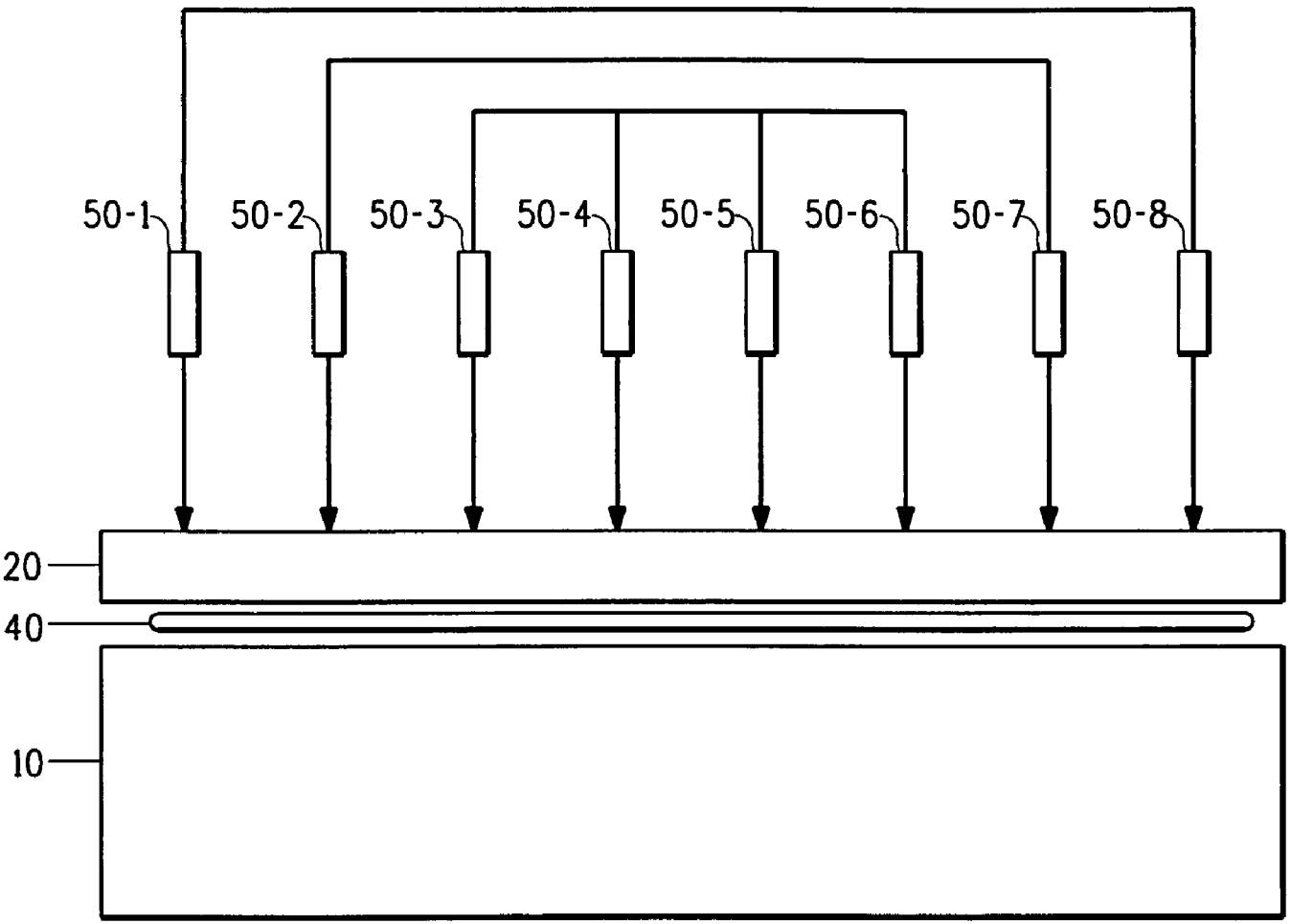
FIG. 4 (Prior Art)
FIG. 4 is a schematic view, corresponding to FIG. 1, showing a prior art arrangement for applying a given pressure profile.
Figure 5:
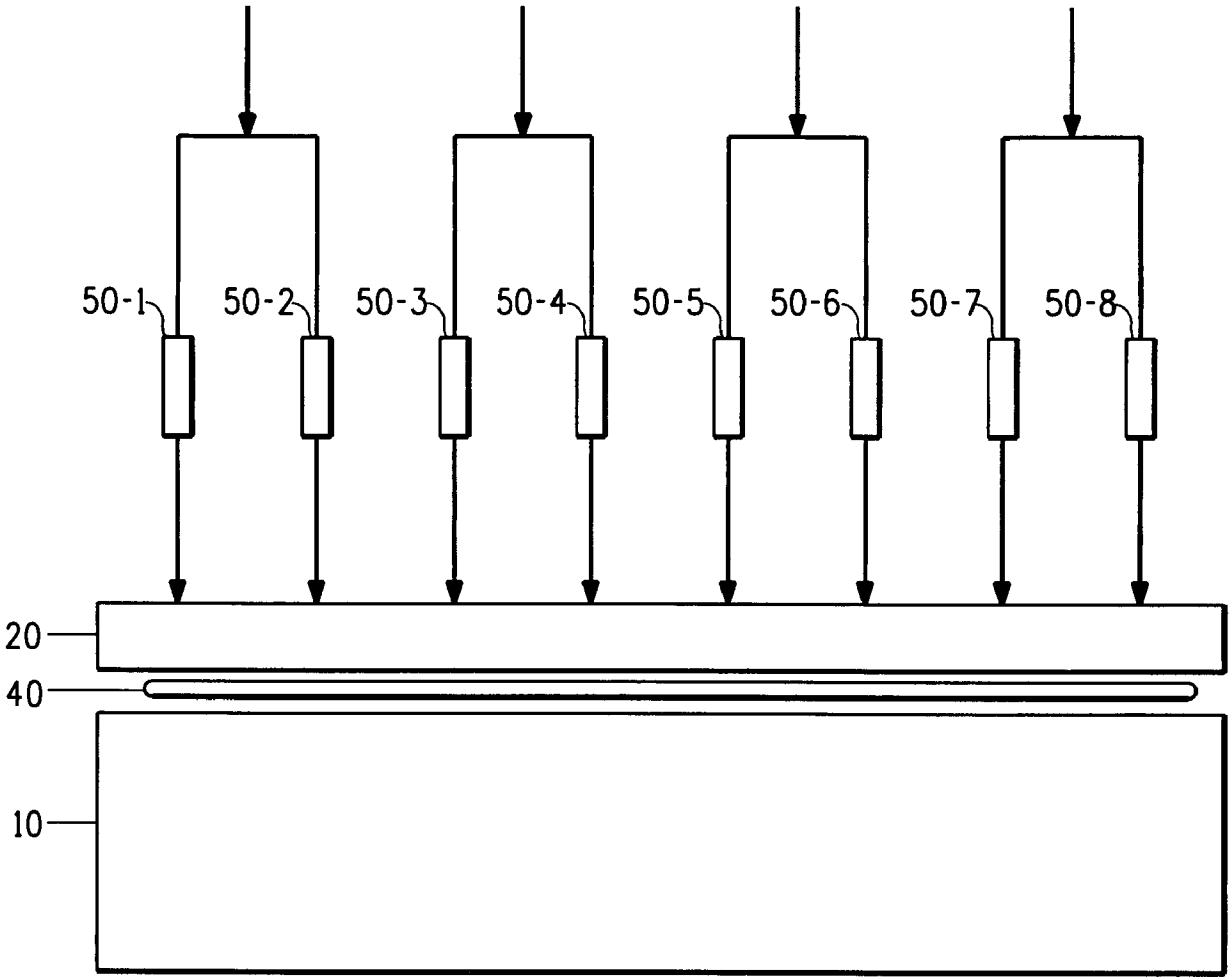
FIG. 5 is a corresponding schematic view showing an arrangement according to the invention for applying a variable pressure profile.

The inventive configuration is compared with the prior art in FIGS. 4 and 5.

In the prior art arrangement of FIG. 4, the two outer pneumatic cylinders 50- and 50-8 are connected together and at the same pressure, the next two inside cylinders 2 and 7 are connected together and at the same pressure, and the four innermost cylinders 3, 4, 5, and 6 are connected together and at the same pressure. In use, the pressure is highest in cylinders 1 to 8, medium in cylinders 2 and 7, and lowest in cylinders 3 to 6 . This provides a symmetric pressure profile with higher (and equal) pressure at the two edges, and lower pressure in the middle.

In the example of the inventive arrangement shown in FIG. 5, the adjacent pneumatic cylinders are connected together in pairs 1-2, 3-4, 5-6, and 7-8, each pair of cylinders being at the same pressure and the four pairs of cylinders being settable independently of one another at different pressures. This provides different adjustable pressure profiles, including the asymmetric profile shown in FIG. 3, where there is a progressive decrease of pressure from one edge of the drum to the other, which permits the different edges of the sheet material 40 to be subjected to different creping pressures.

Other desired pressure profiles can be applied with the inventive arrangement, including, for example, a symmetrical pressure profile with increased pressure at the edges; however, this is only one of the many possibilities now offered by the invention.

It is also possible in the invention to have different numbers of pressure application areas, and the pressure in each pressure application area can be applied from one or more pneumatic cylinders 50 or other pressure application means, such as by using hydraulic cylinders or even lever-activated pressure application devices.

For instance, in an 8-cylinder arrangement, cylinders 1-2, 3-4, 5-6; and 7-8 could be connected in groups, or 1-2-3; 4-5; and 6-7-8 could be connected in groups; or all eight cylinders or some individual cylinders could be independently controlled. Other numbers of cylinders 50 may be used, depending mainly on the width of the drum 20 and of the sheet material 40.

In a typical machine, the applied pressure can vary from 45 psi (310 Kpa) to 100 psi (689 KPa).

A machine retrofitted according to the invention can be automated using the following criteria.

The main critical condition for a creped product is the geometry of the final roll, i.e. the rotary drum 10. This means that the surface of the drum should be level flat and the profile square (both side diameters should be identical) and with no hills or valleys on the surface.

There are different methods for measuring the surface flatness of the sheet material on the drum 10 with good precision. For instance, a non-contact measuring device can provide an electronic signal that can be converted into a pressure to be applied to different pressurizing cylinders used to crepe the product. Thus it is possible to automatically adjust the pressure profile during machine operation. This avoids stopping the machine during the process in order to correct the pressure of the cylinders in correspondence with the geometry of the product.

If the sheet material is a fabric having a varying basis weight profile, the machine can automatically provide an appropriate asymmetric pressure profile across the sheet material. This pressure profile can be different from one fabric to another.

If the sheet material is flat like paper, the machine can automatically apply the type of symmetric pressure profile known from the prior art.

EXAMPLE

The efficiency of the machine according to the invention is compared to that of a prior art arrangement in Table I. Table I reports the testing of a machine set with the prior art pressure profile, compared with the same machine retrofitted according to the invention with an adjustable pressure profile. In both cases, the machine was operated to crepe the same non-woven fabric with the stated operating conditions. Under "defect" it is meant in Table I a fabric which has not been properly creped, that is a fabric which, after undergoing the creping process, shows an increase in the basis weight (kg/$m^2$) of less than 3%.

TABLE I

| | PRIOR ART | | INVENTION | |
|---|---|---|---|---|
| Pressure profile on cylinders | Pressures on cylinders 1-8, 2-7 and 3-4-5-6 | | Pressures on cylinders 1-2, 3-4, 5-6, 7-8 | |
| Applied pressures on different cylinder groups | 1-8 | 70 psi | 1-2 | 70 psi |
| | 2-7 | 65 psi | 3-4 | 60 psi |
| | 3-4-5-6 | 50 psi | 5-6 | 60 psi |
| | | | 7-8 | 55 psi |
| Width of drum/fabric | 2200 mm/1900 mm | | 2200 mm/1900 mm | |
| Speed of advance of the fabric | 60 mpm | | 110 mpm | |
| Number of defects | 2 defects per day | | 1 or 0 defects per day | |

TABLE I-continued

| | PRIOR ART | INVENTION |
|---|---|---|
| Shims | Yes, needed when pressure is not enough | No need for shims; pressure is enough |
| Efficiency | 15 rolls/day | 21 to 24 rolls per day |

With the inventive configuration, the higher pressure (70 psi=482 KPa) was applied on the side of the fabric having the highest basis weight.

As can be seen, the machine retrofitted according to the invention operates at increased speed with fewer defects and higher efficiency.

I claim:

1. A machine for creping sheet material, comprising a sheet material driving device, pressing means having a pressure-applying edge for pressing a length of sheet material against the driving device extending across the width of the driving device, and a retarding member located adjacent to and downstream of the pressure-applying edge and having a surface arranged to contact the sheet material to cause it to crepe, wherein the pressing means comprises a plurality of independently adjustable pressure application areas distributed across its width for applying different pressures to different parts of the sheet material across its width, and wherein the machine further comprises means for measuring the thickness of different parts of the sheet material across the driving device, said measuring means providing a signal for controlling the application of pressure to said different parts of the material across its width according to the measured thickness of the material.

2. The machine of claim 1, wherein the pressing means comprises a series of pressure plates, each of which is independently activated by pressure-applying members.

3. The machine of claim 2, wherein the pressure-applying members are pressure-activated cylinders.

4. The machine of claim 3, wherein the pressure-activated cylinders are pneumatic cylinders.

5. The machine of claim 1, wherein the retarding member has an inclined surface that is inclined to the sheet material driven by the driving device.

6. The machine of claim 1, wherein the pressing means comprises from three to eight pressure application areas.

* * * * *